United States Patent [19]

Moore

[11] Patent Number: 4,627,606

[45] Date of Patent: Dec. 9, 1986

[54] BOTTOM SHEET FEEDING APPARATUS EMPLOYING A COMBINATION SLIDE PLATE AND VACUUM VALVE

[75] Inventor: Kenneth P. Moore, Rochester, N.Y.

[73] Assignee: Xerox Corporation, Stamford, Conn.

[21] Appl. No.: 681,415

[22] Filed: Dec. 13, 1984

[51] Int. Cl.[4] ..... B65H 3/08

[52] U.S. Cl. ..... 271/98; 271/132; 271/106

[58] Field of Search ..... 271/97, 98, 99, 132, 271/136, 138, 104, 107, 106

[56] References Cited

U.S. PATENT DOCUMENTS

| | | | |
|---|---|---|---|
| 2,827,290 | 3/1958 | Dixon et al. | 271/32 |
| 3,279,788 | 10/1966 | Shields | 271/99 |
| 3,285,602 | 11/1966 | Hartel | 271/32 |
| 3,588,093 | 6/1971 | Ward et al. | 271/132 X |
| 3,782,716 | 1/1974 | Long et al. | 271/99 |
| 3,874,654 | 4/1975 | Holt et al. | 271/99 |
| 3,874,655 | 4/1975 | Allen et al. | 271/99 |
| 3,973,768 | 8/1976 | Shannon | 271/132 X |
| 4,008,889 | 2/1977 | Ayres | 271/132 X |
| 4,009,876 | 3/1977 | Smiltneek | 271/99 |
| 4,010,944 | 3/1977 | Young | 271/99 |
| 4,070,015 | 1/1978 | Muka | 271/100 |
| 4,121,819 | 10/1978 | DiFrancesco et al. | 271/96 |
| 4,127,263 | 11/1978 | Wenthe | 271/96 |
| 4,179,215 | 12/1979 | Hage | 355/50 |
| 4,284,270 | 8/1981 | Silverberg | 271/99 X |
| 4,299,381 | 11/1981 | Smith | 271/98 |
| 4,411,417 | 10/1983 | Browne | 271/94 |
| 4,506,875 | 3/1985 | Capdebosco et al. | 271/132 X |

FOREIGN PATENT DOCUMENTS

| | | | |
|---|---|---|---|
| 0072533 | 5/1982 | Japan | 271/99 |
| 2059924A | 4/1981 | United Kingdom . | |

OTHER PUBLICATIONS

Xerox Disclosure Journal Publication, vol. 9, No. 4, Jul./Aug. 1984—p. 239.

*Primary Examiner*—Bruce H. Stoner, Jr.
*Assistant Examiner*—Matthew C. Graham
*Attorney, Agent, or Firm*—William A. Henry, II

[57] ABSTRACT

A bottom sheet feeding apparatus including a sheet separator and feeder and a sheet stacking tray which has a planar base portion defining a base plane, the front of the base portion having an opening within which the bottom sheet separator and feeder is positioned, the tray further including two sloping planar side wings, one at each side of the opening in the base portion. In a preferred embodiment, the sheet separator and feeder includes a slide plate with a vacuum applied thereto. The slide plate has a sloping front portion for more positively separating the bottom sheet in a sheet stack from the remaining sheets.

2 Claims, 7 Drawing Figures

BOTTOM SHEET FEEDING APPARATUS EMPLOYING A COMBINATION SLIDE PLATE AND VACUUM VALVE

BACKGROUND OF THE INVENTION

The present invention relates to sheet feeding apparatus and in particular to a slide plate vacuum valve for use with a bottom vacuum corrugating feeding apparatus.

With the advent of high speed xerographic copy reproduction machines wherein copies can be produced at a rate in excess of three thousand copies per hour, the need for a document handler to feed documents to the copy platen of the machines in a rapid, dependable manner was recognized to enable full utilization of the reproduction machines' potential copy output. A number of document handlers are currently available to fill that need. These document handlers must operate flawlessly to virtually eliminate the risk of damaging the originals and generate minimum machine shutdowns due to uncorrectable document misfeeds or document multifeeds.

Since the documents must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face, can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

In addition, a typical vacuum separation and feeding system is that described in U.S. Pat. No. 4,411,417 which is incorporated herein by reference. Systems of that type use a solenoid operated butterfly-type vacuum valve to cycle vacuum flow. These systems are a marked improvement over prior feeders, however, the solenoid operated valve is a source of machine failure and the friction belts of the system in U.S. Pat. No. 4,411,417 that are arranged to run over a vacuum plenum placed at the bottom of a sheet tray are a source of concern for belt slip. Also, the belts allow air from an air knife that is used to separate sheet one from sheet two to pressurize under the lead edge of sheet one, causing flutter. The belt holes also allow vacuum leakage at the lead edge, increasing the probability of more than one sheet being fed at a time.

SUMMARY OF THE INVENTION

It is an object of the present invention to provide an improved bottom sheet feeder.

It is a further object of the present invention to improve the efficiency of air usage in a bottom vacuum sheet feeder with an air injection means at the lead edge of a stack of sheets to be fed.

It is yet another object of the present invention to provide a bottom sheet feeder that is more reliable, less noisy and less costly while being adapted to feed a wider variety of sheet sizes, weights and conditions.

These and other objects of the present invention are obtained with a bottom sheet feeding and separating apparatus that replaces the vacuum belt feed systems of prior vacuum corrugation feeders with a vacuum slide plate feed system. The plate is placed over the vacuum plenum in a low friction slide mechanism and is driven forward to transport a sheet and then retracted to its original position ready to feed the next sheet and thereby eliminating many problems associated with vacuum belt systems such as belt wear, slippage, coast or over-travel, stretching, tracking and air leakage.

In a specific aspect of the present invention, the sliding plate is adapted to valve the vacuum flow as it reciprocates thereby increasing the reliability of the system while reducing the cost by eliminating a separate valve to control vacuum flow.

In yet another aspect of the present invention, a three sided wall or dam is disclosed for improving acquisition of sheet one from a stack of upcurled sheets. The wall is mounted to pivot inside the vacuum plenum; up to acquire sheet one and then down to enhance the attachment of sheet one to the slide plate surface. The wall is adapted to not interfere with the slide plate movement once sheet one has been acquired and the wall is retracted.

For a better understanding of the invention as well as other objects and further features thereof, reference is made to the following drawings and description.

DESCRIPTION OF THE PREFERRED EMBODIMENT

The invention will now be described by reference to a preferred embodiment of the bottom sheet feeding apparatus.

Figure 1:
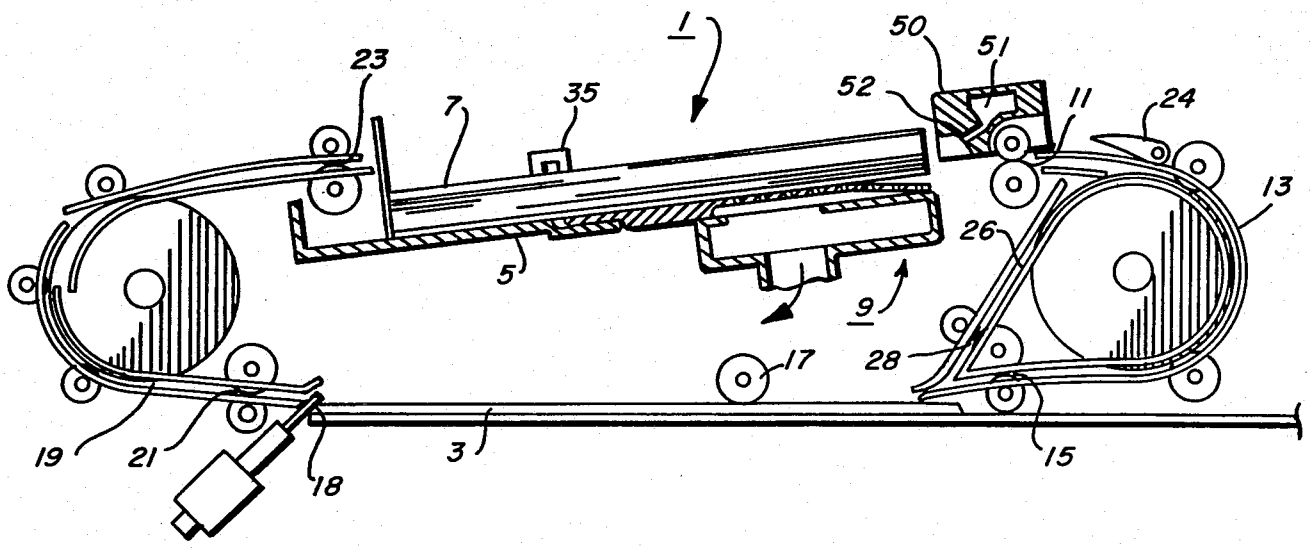
FIG. 1 is a cross-sectional view of an exemplary recirculating sheet feeder employing the present invention.

Referring particularly to FIG. 1, there is illustrated an exemplary automatic sheet separator feeder for installation over the exposure platen 3 of a conventional xerographic reproducing machine. This is merely one example of a document handler with which the exemplary sheet separator feeder may be combined. It should be understood that the present invention is equally suitable for the feeding of sheets in a bottom or top feeder. The document handler 1 is provided with a document tray 5 adapted for supporting a stacked set of documents 7. A vacuum corrugating slide plate feeder mechanism 9 is located below the front end of the document tray for acquiring and corrugating the bottom document sheet in the stack and for feeding out that document sheet to take-away roll pair 11 through document guides 13 to a feed-roll pair 15 and under platen roll 17 onto the platen of the copy machine for reproduction. A rectractable registration edge 18 is provided here to register the lead edge of the document fed onto the platen. Following exposure of the document, the edge 18 is retracted by suitable means such as a solenoid and that document is fed off the platen by roll 17 and onto guides 19 and feed-roll pair 21 and returned back to the top of the document stack 7 through a feed-roll pair 23. Gross restacking lateral realignment is provided by an edge guide (not shown) resettable to a standard sheet size distance from an opposing fixed edge guide.

In the event it is desired to present the opposite side of a document for exposure, the document is fed from the stack 7 through guides 13 until the trail edge passes document diverter 24. Document diverter 24 is then rotated counterclockwise, i.e., into the document sheet path. The document direction is reversed and the document is diverted by divertor 24 through guides 26 and feed-roll pair 28 onto the platen 3.

The document handler 1 is also provided with a sheet separator finger 35 as is well known in the art, to sense and indicate the documents to be fed versus those documents returned to the document handler, i.e. to count each set circulated. Upon removal (feed out) of the last document from beneath sheet separator finger 35, the finger 35 drops through a slot provided in the tray 5 to actuate a suitable sensor indicating that the last document in the set has been removed from the tray. The finger 35 is then automatically rotated in a clockwise direction or otherwise lifted to again come to rest on top of all the documents in the stack 7, for the start of the next ciruclation of document set 7.

Figure 2:
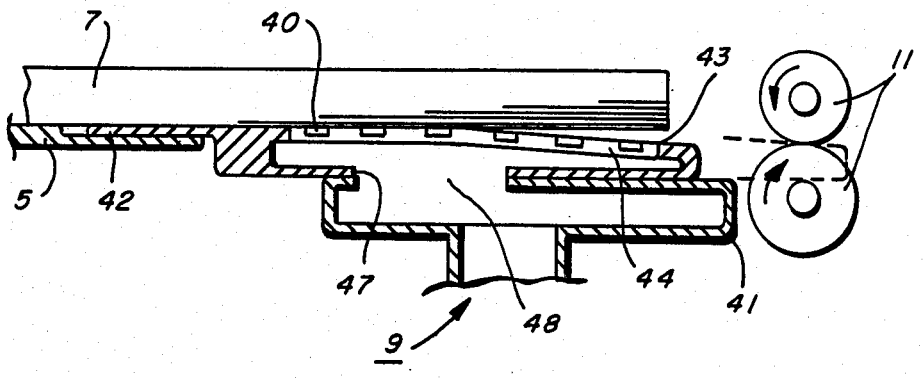
FIG. 2 is a partial cross-sectional view showing the slide plate in its home position in solid lines and in its maximum extended sheet feeding position in dotted lines.

Referring more particularly to FIG. 2, and the slide plate apparatus 9 according to an aspect of the present invention, a top plate 40 is adapted to slide over vacuum plenum 41 and configured such that it automatically valves the amount of negative pressure applied to the plate as it progresses across the plenum in the process of feeding a sheet. Plate 40 is a lightweight plastic member and is mounted over vacuum plenum 41 in a low friction slide (not shown). When a signal is received by the feeder for feeding a sheet or document 7, vacuum is applied from a conventional source to plenum 41 and through holes in the top surfaces of both the vacuum plenum and top plate to draw and bow the bottommost sheet in the set of documents down against the downwardly sloped front end 43 of plate 40 in order to separate the bottom sheet from the rest of the sheets. Top plate 40 is then driven by a solenoid, cam, rack and pinion system, or clutch actuated belt drive carrying the paper to take-away rolls 11 where the sheet is captured by the nip between the rolls 11 and forwarded toward diverter gate 24. Plate 40 is then retracted to its original or home position, ready to feed the next sheet. When plate 40 is driven out to the dotted line position, another surface 42 is below the stack to maintain levitation of the stack. As can be seen from the dotted lines in FIG. 2, some vacuum pressure and total sheet support are maintained all the way to take-away rolls 11 due to a cut-out portion along the front edge of the plate 40 that is adapted to matingly encircle the nip of take-away rolls 11 as seen in FIG. 3, which gives the slide plate feeder of the present invention quite an advantage over prior belt feeding systems.

Additional advantages of the present slide feeding system over belt or retard feeding systems include the following: (1) The point of applied vacuum at the lead edge of the sheets is always in the same place because the plate always retracts to the same position. This allows the lead edge of the vacuum slots 44 to be close to the lead edge of the stack without leakage. Closer vacuum hold-down to the lead edge lessens the likelihood of the captured sheet being blown off the plate by the air knife to be described hereinafter. Also, the likelihood of the second sheet being driven out because it was tacked to the belts by lead edge leakage flow is lessened. (2) Acquired sheets can be accelerated without concern for belt slippage or stretch. (3) A much lower static drag is obtained with a slide plate system allowing sheets to be fed more efficiently. High drag need not be added to prevent belt "coast" after drive roll turn off. (4) There is no "swallowing" of air knife flow by the vacuum plenum when sheet one is moved to the take-away rolls because the sheet remains acquired to the slide plate while it is moved to the take-away rolls. Upon reaching the take-away rolls, the vacuum valve comprised of surface 47 of the slide plate apparatus closes off orifice 48 to stop vacuum plenum flow.

Figure 3:
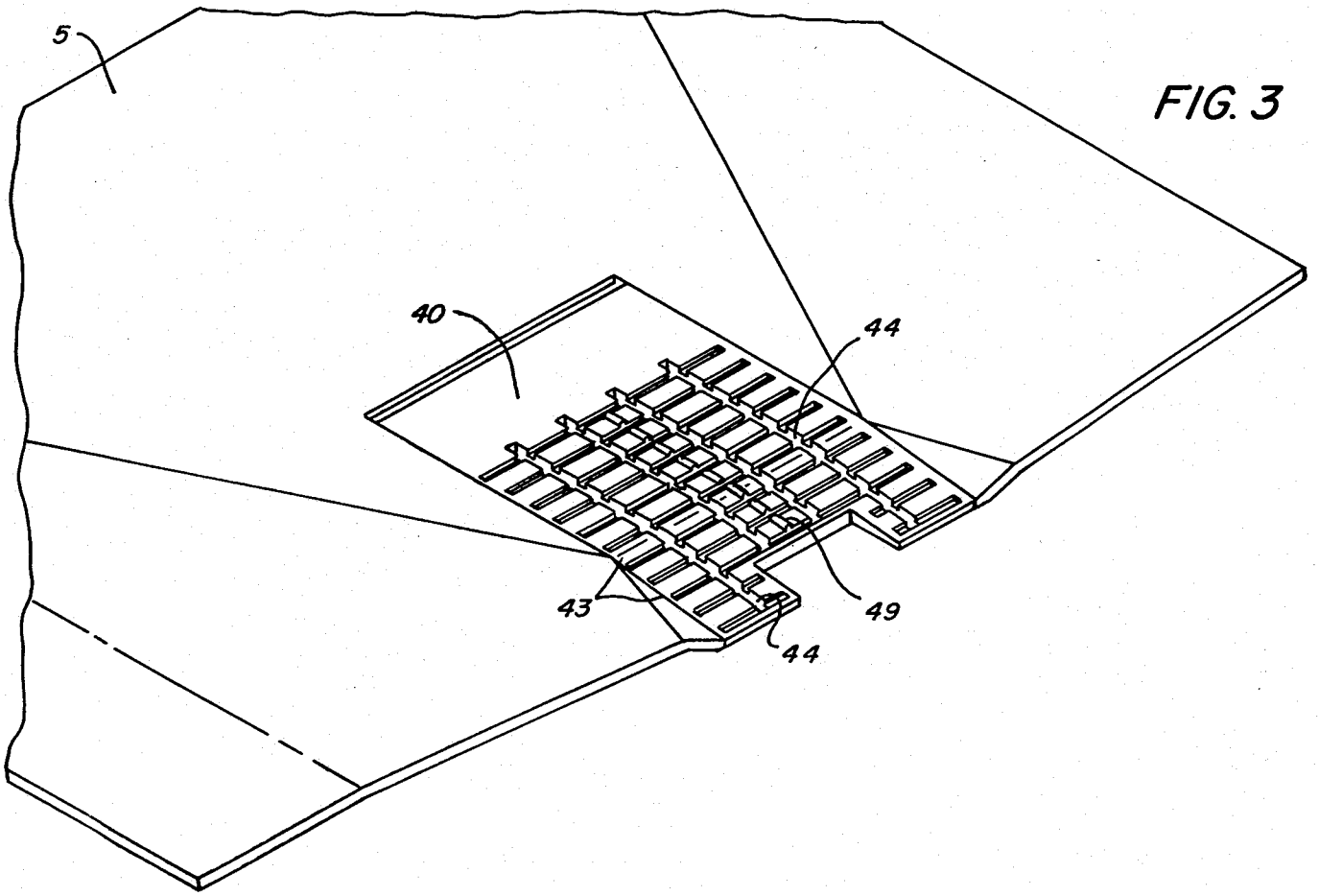
FIG. 3 is an isometric view of the slide plate of the present invention mounted in a preferred sheet stacking tray.

The top slide plate 40 as viewed in FIG. 3 is mounted within the base portion of a sheet support tray 5 that is preferred for use with the present invention. The configuration of the tray is disclosed in U.S. Pat. No. 4,411,417 which has been incorporated herein by reference. A portion of the surface of slide plate 40 has a lattice type design that in addition to the sloped portion 43 provides an amount of corrugation to sheets attracted to the plate thereby serving to enhance separation of sheet one from sheet two. To increase the corrugation, a raised ridge 49 is added along the center of the lattice design. Various designs other than lattice will work as long as vacuum can be applied to the bottom sheet of a stack. Also, the surface of slide plate 40 could be coated with a high friction material if one desired thereby lowering the required vacuum pressure and noise. The vacuum pressure and noise could also be lowered by increasing the vacuum port area.

With the addition of a raised ridge 49 along the center of the lattice work area of the plate 40, a center corrugation will be produced in the bottom sheet. This raised portion may project above the plane of the remainder of plate 40 by approximately 2 mm. Thus, the document is corrugated into a double valley configuration. The flat surfaces of the plate 40 on each side of the raised center generates a region of stress on the document which varies with the document beam strength. In the unlikely event that more than one document is pulled down into contact with the vacuum slide plate, the beam strength of the second (overlying) document resists this corrugating action. Thus, gaps are opened between the first and second sheets, which gaps extend to the sheet lead edges. These gaps reduce the vacuum pressure levels between these sheets due to porosity in the first (bottom) sheet and provide for entry of the separating air flow from the air knife 50.

The air knife 50 (see FIG. 1) is comprised of a pressurized air plenum 51 having a plurality of separated air jet openings or orifices 52 to inject air between the bottommost document pulled down against the feed plate and the documents in the stack thereabove to provide an air cushion or bearing between the stack and the bottom document to minimize the force needed for removing the bottom document from the stack. With the use of this air knife in conjunction with the above described bottom sheet corrugator, even if two documents are pulled down toward the plate 40, since the top sheet would not be corrugated, the air knife would inject air into the space between the two documents and force the second document off from the raised belt back toward the document stack.

As can be seen by reference to FIG. 1, the air knife is canted such that the air streams are discharged at an angle to the plane of the surface of plate 40. With this disclosed interrelationship between the vacuum feed slide, the lead edge of the stack of sheet being slightly removed from the front edge of the tray, and the air knife location and angular orientation, the document feeder is capable of reliably separating and feeding individual document sheets even if the sheets have some up-curl or down-curl.

By suitable valving and controls, it is also desirable to provide a delay between the time the vacuum is applied to pull the document onto the feed plate and the start up of the drive mechanism for the feed plate to assure that the bottom document is captured on the plate before plate movement commences and to allow time for the air knife to separate the bottom sheet from any sheets that were pulled down with it.

To further increase the efficiency of the system, the stack tray is provided with a rearward tilt as shown in FIG. 1. When flotation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds, and providing alignment or initial end registration of the stack 7 on the axis (in the feeding direction).

Figure 4:
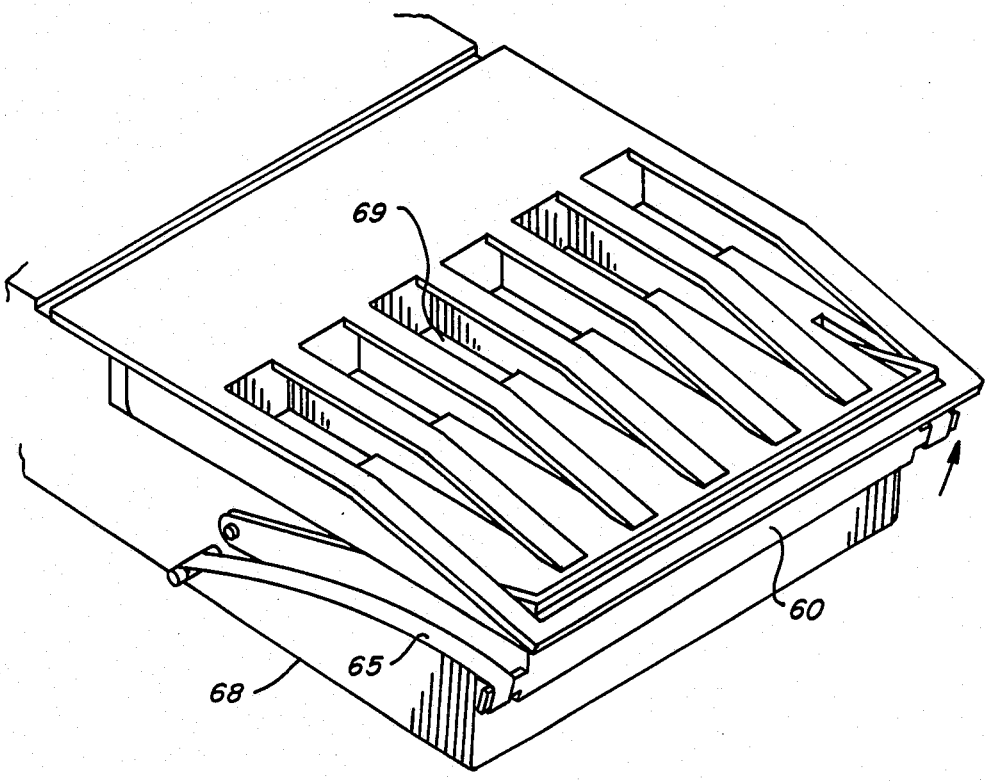
FIG. 4 is an isometric view a leaf spring mounted three-sided air dam and a vacuum plenum on which a slide plate is to be mounted.

In reference to FIG. 4, an alternative embodiment of the present invention is shown that insures the feeding of document sets with major up-curled as well as flat sheets and comprises a low cost three sided sheet metal wall or air dam 60. The air dam is mounted to pivot inside vacuum plenum 68 in order to improve acquisition of sheet one. Leaf spring 65 normally biases the air dam up to the front edge of the stack and blocks air knife 50 nozzles during sheet acquisition thereby preventing pressure from the air knife from lifting up a stack of upcurled sheets and causing misfeeds. Once the feeding of a sheet is required and the vacuum system pulls a sheet against the air dam, the weight of the sheet and suction from the vacuum system rides the air dam down onto a slide feeding plate (not shown) on top of the vacuum chamber by overriding the opposite force of leaf spring 65. The air dam stays down until the acquired sheet has left the tray and automatically returns to its normal position once the sheet has been fed. The air dam prevents "swallowing" of flow from air knife 50 by the vacuum plenum by blocking passage of air to the vacuum ports. While the air dam is blocking air knife flow from being swallowed by the vacuum plenum, it is facilitating a higher and faster negative pressure rise below sheet one. Further, since the vacuum flow through slots 69 need not overpower air knife flow for sheet acquisition to occur in the system, vacuum pressure can be consistently lower. This would be independent of air knife pressure thereby resulting in lower noise and more efficient sheet acquisition.

In reference to slide plate 40 of FIG. 2, the negative pressure from vacuum plenum 41 is automatically controlled by member 47. As the slide plate moves toward the take-away rolls 11, member 47 covers and increasing part of the opening 48 in the plenum thereby decreasing the suction force on the sheet acquired on top of the slide plate during the movement of the sheet to the position shown in dotted lines. This makes for ease of separation of the sheet from the slide plate by take-away rolls 11 and eliminates an extra vacuum control valve from the system. Member 47 insures that the vacuum is cut off once the slide plate has moved all the way to the take-away rolls.

Figure 5A:
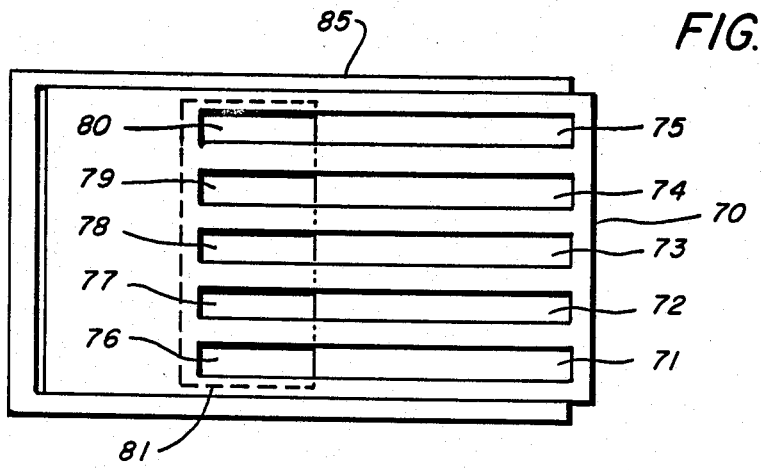
FIGS. 5*a*–5*c* are plan views of an alternative embodiment of a slide plate and automatic vacuum valve mechanism.
Figure 5B:
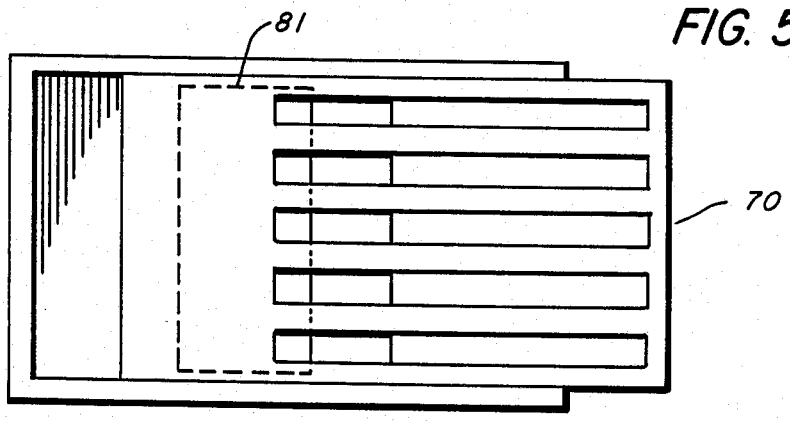
Figure 5C:
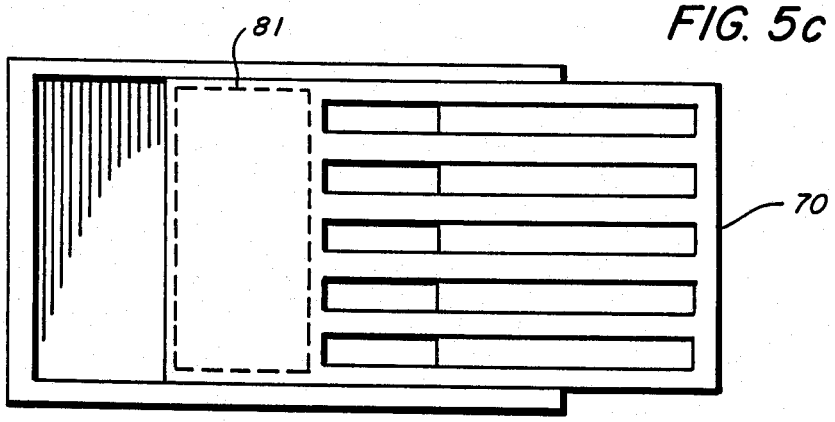

An alternative embodiment of an automatic vacuum valve slide plate is shown in FIGS. 5*a* through 5*c* that is especially adapted for use with a feeding system similar to FIGS. 2 and 4 and comprises a slide plate 70 with a slotting arrangement 71–75 positioned within a major portion of the plate 70 in order to eliminate a vacuum valve and facilitate automatic valving of the vacuum in plenum 81. The slots 71–75 open to vacuum port holes 76–80 that are connected to vacuum plenum 81. As shown in FIGS. 5*a*–5*c*, plate support structure 85 would have a stack of sheets sitting thereon with the front edge of the stack resting on the front edge of support structure 85 and slide plate 70. In this position, sheet one obtains maximinum flow from vacuum ports 76–80 by way of channels 71–75. In FIG. 5*b*, as the slide plate 70 is driven out toward take-away rolls (after sheet acquisition), less drive force is required and vacuum begins to be cut off because only portions of ports 76–80 are still in communication with plenum 81. Once the lead edge of sheet one reaches the take-away rolls as represented by FIG. 5*c*, vacuum pressure from plenum 81 is completely cut off. The slide plate is then returned to its home position for feeding another sheet and as has been shown, high acquisition flow is not applied until slide plate 70 is very near acquisition position.

In operation of the apparatus of FIG. 1, a stack of sheets is placed in the sheet stacking tray and the following sequence of events occurs. The vacuum plenum is pressurized which tends to pull the bottommost sheet down onto the plenum. The air knife is actuated. At the same time, the bottommost sheet tends to separate slightly from the remainder of the stack of sheets, particularly at the front edge due to the downward sloping configuration of the forward end of the slide plate. The air knife injects pressurized air into the pocket formed between the first sheet and the remainder of the stack and thereby levitates the remainder of the stack facilitating separation of the bottommost sheet from the stack. The slide plate feed assembly is actuated, driving the bottommost sheet from beneath the stack in a forward direction. As the leading edge of the bottommost sheet enters the take-away rolls, vacuum from the plenum is automatically turned off, due to the novel design and cooperation of the slide plate and vacuum plenum and for each successive sheet being fed the cycle is repeated.

In summary, it should be apparent from the above description of the invention that a more efficient, reliable, less noisy and less costly sheet separating and feeding system is provided. In particular, the separating and feeding system includes a slide plate positioned within the front portion of a sheet supporting tray. The plate is placed over a vacuum plenum and is adapted to slidingly forward a sheet attracted thereto by the vacuum plenum to take-away rolls. The slide plate is then retracted to its original position for feeding the next sheet. Configuration and cooperation of the slide plate and the vacuum plenum are such that the negative pressure to the slide plate is automatically valved to decrease on forward movement and increase on reverse movement. This system eliminates many of the problems associated with belt feed systems such as, belt wear, slipping and stretching.

It will be appreciated that the described device may be modified and varied by the skilled artisan upon a reading of the present disclosure. For example, while the present invention has been described with reference to a document handler in an automatic copying machine it has application in principle to any sheet feeding device. This alternative as well as other modifications as may readily occur to the artisan are intended to be within the scope of the present invention.

What is claimed is:

1. A bottom sheet separator-feeder for separating and forwarding sheets seriatim from the bottom of a stack of sheets to be fed, comprising a stack tray for supporting the sheets to be fed, air knife means positioned in front of the stack tray and adapted to provide a layer of air between said tray and the bottom sheet in the stack and the remainder of the sheets in the stack, and vacuum feeding means located within the front portion and in line with the top surface of said tray, said feeding means including a slide plate member having a first surface portion extending along the plane of the bottom surface of said tray and a second surface portion that is sloped down and away from said first surface portion and said tray and extending the width of said tray for bending the front portion of the bottom sheet in the stack down and away from the remainder of the stack, said slide plate member having a plurality of sheet hold down slots in said first and second surface portions and a vacuum plenum arranged for communication with said sheet hold down slots to attract the bottommost sheet in the stack to said slide plate member, said vacuum plenum remaining stationary while said slide plate member is reciprocated to move sheets from under said stack to a take-away position, and including a two position wall connected to said vacuum plenum and positioned with respect to a forward end of said vacuum plenum for blocking air knife flow to the stack during initial sheet acquisition when in a first of said two positions while simultaneously facilitating a higher and faster negative pressure rise below the stack and for allowing full air knife flow to the stack when in the second of said two positions.

2. The sheet separator-feeder of claim 1, wherein said wall has portions located on three sides of said vacuum plenum.

* * * * *